United States Patent [19]

Greive et al.

[11] Patent Number: 4,561,600

[45] Date of Patent: Dec. 31, 1985

[54] BOBBIN HOLDER

[75] Inventors: Aloys Greive, Kempten; Dieter Leuthold, Wiggensbach, both of Fed. Rep. of Germany

[73] Assignee: Saurer-Allma GmbH, Kempten, Fed. Rep. of Germany

[21] Appl. No.: 655,189

[22] Filed: Sep. 26, 1984

[30] Foreign Application Priority Data

Oct. 4, 1983 [DE] Fed. Rep. of Germany ... 8328512[U]

[51] Int. Cl.[4] ..... B65H 54/02; B65H 54/553

[52] U.S. Cl. ..... 242/18 DD; 242/18 PW; 242/129.51

[58] Field of Search ..... 242/18 DD, 18 PW, 18 A, 242/25 A, 129.51

[56] References Cited

U.S. PATENT DOCUMENTS

| | | | |
|---|---|---|---|
| 2,776,098 | 1/1957 | Baumann et al. | 242/129.51 |
| 3,921,921 | 11/1975 | Katayama et al. | 242/18 PW X |
| 4,013,242 | 3/1977 | Burysek et al. | 242/129.51 |
| 4,042,188 | 8/1977 | Richards | 242/129.51 |
| 4,102,507 | 7/1978 | Hoffmann et al. | 242/18 PW |
| 4,125,229 | 11/1978 | Dillon | 242/18 PW X |
| 4,299,357 | 11/1981 | Munker | 242/18 DD |

FOREIGN PATENT DOCUMENTS

| | | | |
|---|---|---|---|
| 87376 | 8/1983 | European Pat. Off. | 242/18 DD |
| 88708 | 9/1983 | European Pat. Off. | 242/18 DD |
| 7126191 | 10/1971 | Fed. Rep. of Germany | 242/18 DD |
| 2536477 | 7/1976 | Fed. Rep. of Germany | 242/18 DD |
| 1351592 | 5/1974 | United Kingdom | 242/18 DD |
| 2044813 | 10/1980 | United Kingdom | 242/18 DD |

*Primary Examiner*—Stanley N. Gilreath

*Attorney, Agent, or Firm*—Flynn, Thiel, Boutell & Tanis

[57] ABSTRACT

A bobbin holder (1) having a pivotally mounted bobbin frame (2) is provided at its two support arms (3*a*, 3*b*) with a respective freely rotatably mounted tube plate member, of which one plate member (7) has a centering projection (10) for receiving the bobbin tube (5), has axially therebeside at least one thread catch means (12) and has a mounting projection (11) which concentrically surrounds a mounting pin portion (18) and which projects towards the support arm (3*a*). Over a part of its axial length, the mounting projection (11) is concentrically surrounded by a sleeve-like portion (15) provided on the support arm. In its region which is not surrounded by the sleeve-like portion (15), the mounting projection (11) is provided with a peripheral groove (16) for winding up an overhanging free thread end portion (FE) which is not engaged by the catch means (12, 13, 14).

9 Claims, 7 Drawing Figures

BOBBIN HOLDER

FIELD OF THE INVENTION

The invention relates to a bobbin holder having a pivotally mounted bobbin frame and a respective tube plate member freely rotatably mounted on each of the two support arms of the bobbin frame, of which one plate member has a centering projection for carrying the bobbin tube, has axially therebeside at least one thread catch means, and has a mounting projection which is disposed concentrically around the mounting spindle portion, which projects towards the support arm and which is concentrically enclosed over a part of its axial length by a sleeve-like portion provided on the support arm.

BACKGROUND OF THE INVENTION

In a known bobbin holder of that kind (German laid-open application (DE-OS) No. 29 33 320), the tube plate member, beside the centering projection, has a flange which is provided with a plurality of catch notches. The edges of the catch notches are pointed to form a knife-like configuration. At the beginning of the winding operation, the thread which is to be wound on is fitted on a stationary thread guide which is disposed laterally of the bobbin frame, whereby the thread passes over one of the tube plate members. The thread then goes to a suction nozzle, from the stationary thread guide. When now the bobbin tube is caused to rotate by the friction roller, with the tube plate member also rotating therewith, the thread is engaged by one of the catch notches and is entrained over a part of the rotational movement of the tube plate member. If, as a result of that, the tension in the thread between the stationary thread guide and the tube plate member exceeds a certain value, the thread is to be cut off by the knife-like configuration of the edges of the catch notches. The cut-off end of the thread is then removed by the suction nozzle. Therefore, a necessary condition for that apparatus to operate at all is that there is a suction nozzle at each bobbin station. However, after the thread has been severed, the end of the thread which is on the tube or the tube plate member is not held with an adequate degree of certainty for it passes around the tube plate member or the tube only over a part of the periphery thereof. The fact that the thread does not extend around the tube or the tube plate member to a sufficient degree makes itself felt primarily when a large amount of thread has already been wound on the tube. As the leading end portion of the thread is not securely held on the tube plate member or the tube, it can come loose and it is therefore necessary to start the bobbin winding operation again. It may also happen that the thread is not severed by the knife-like configuration of the edges of the catch notches, as is the intention, but breaks due to the increased tension in the thread at some point between the suction nozzle and the tube plate member. In that case, the result is a thread end portion of greater length which projects beyond the tube plate member and which, upon rotational movement thereof, winds itself around the sleeve-like portion on the support arm. The coil of thread which is formed at that location then has to be removed again, by hand, which is an irksome operation.

The invention is based on the problem of providing a bobbin holer of the kind set forth in the opening part of this specification, which makes it possible for the thread to be substantially automatically and securely engaged, irrespective of the bobbin winding diameter, that is to say, when the tube or the bobbin is empty or has some thread wound around it, during the rotational movement of the bobbin in such a way that, when the bobbin is removed, there is also an adequate end portion of thread at the end of the bobbin, and that in addition thread is prevented from winding itself around the mounting means of the tube plate member.

SUMMARY OF THE INVENTION

In accordance with the invention, that is achieved in that the mounting projection, in its region which is not enclosed by the sleeve-like portion, is provided with a peripheral groove for winding on an overhanging free end of thread which is not engaged by the thread catch means.

In that respect, the basic concept of the present invention is that the free end of the thread, which is not engaged by the catch means and which hangs out beyond the thread catch means, is not for example cut off but is left on the tube plate member and wound on the mounting projection thereof. That provides that, at any bobbin winding diameter, that is to say, both when the bobbin tube is empty and also when the bobbin tube has been partially or almost completely wound around with thread, the end portion of the thread is securely fastened to the tube plate member. For that purpose, the end of the thread only has to be taken manually or automatically at an inclined angle over the tube plate member while it is rotating, in which respect the distance by which the end portion of the thread projects beyond the tube plate member is irrelevant. The thread catch means then engages the thread so that the thread coming from the spinning or twisting station is firstly wound on the tube plate member and then on the tube or bobbin. As that thread always remains joined to the end portion of thread that projects beyond the tube plate member and that end portion is wound around the mounting projection, that arrangement also ensures that the thread is always satisfactorily fixed on the tube plate member. The mounting projection which rotates with the tube plate member and the groove provided in the mounting projection form an intentional winding-on means for the overhanging free end of the thread. That ensures that the free end portion of the thread does not wind itself around any mounting components or other components of the bobbin frame. When the fully wound bobbin tube is removed from the bobbin frame, then the end portion of the thread which is wound on the mounting projection also automatically unwinds itself again from the mounting projection, since the tube plate member is easily rotatably mounted in the bobbin frame. There is therefore no need for a particular operation for removing a coil of thread and in addition the end portion of the thread which is unwound from the mounting projection is certain to form a sufficiently long thread end portion that projects beyond the end of the bobbin. Another important consideration is that, at any speed of rotation of the bobbin tube or bobbin, the thread is automatically engaged by the tube plate member and secured thereto.

Advantageous embodiments of the invention are set forth in the subsidiary claims.

BRIEF DESCRIPTION OF THE DRAWINGS

The invention is described in greater detail hereinafter with reference to a number of embodiments illustrated in the drawings in which.

DETAILED DESCRIPTION

Figure 2:
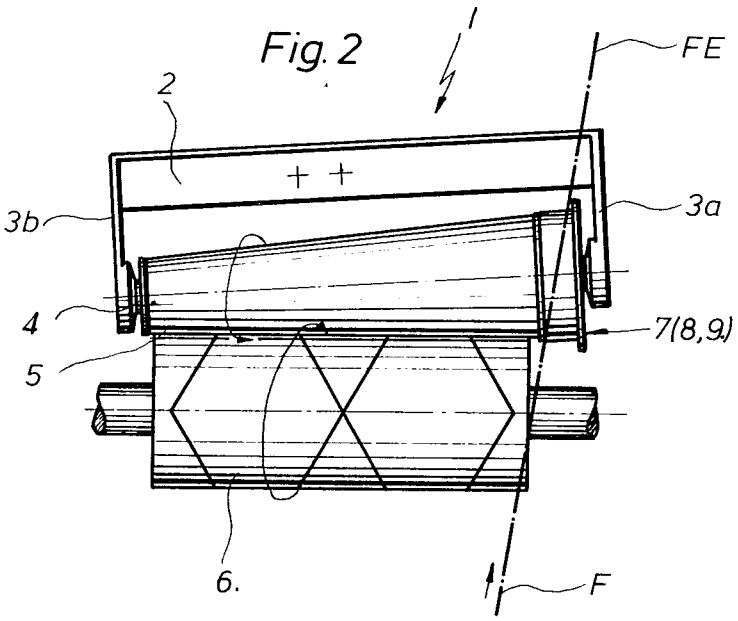
FIG. 2 shows a front view of the bobbin holder.

The bobbin holder 1 (FIGS. 1 and 2) comprises a pivotally mounted bobbin frame 2 having two support arms 3*a* and 3*b*. Freely rotatably mounted on one support arm 3*b* is a conventional tube plate or disc member 4 which only has a centering projection for fitting and centering the bobbin tube 5 thereon. During the winding operation, the bobbin tube 5 or the bobbin bears against a grooved drum 6 or a friction drive roller.

The tube plate or disc member 7 (8, 9) mounted on the support arm 3*a* is of a particular configuration. Each of the tube plate members 7,8 and 9 shown in greater detail in FIGS. 3 to 7 is provided with a centering projection 10 on its one face and a mounting projection 11 on its other face. Disposed therebetween is a respective thread catch means 12, 13 and 14 which is of a different configuration in each of the three different embodiments illustrated. Common to all the illustrated embodiments however is the specific configuration of the mounting projection 11 which is enclosed over a part of its length by a sleeve-like portion 15 on the support arm 3*a*. In that region in which the mounting projection 11 is not encircled by the sleeve-like portion 15, the mounting projection 11 has a peripheral groove 16. Adjoining same at 17 at the free end thereof is a flange which is enclosed by the sleeve-like portion 15, disposed at a small radial spacing therefrom. A mounting pin portion 18 connected to the support arm 3*a* extends into the mounting projection 11.

Figure 3:
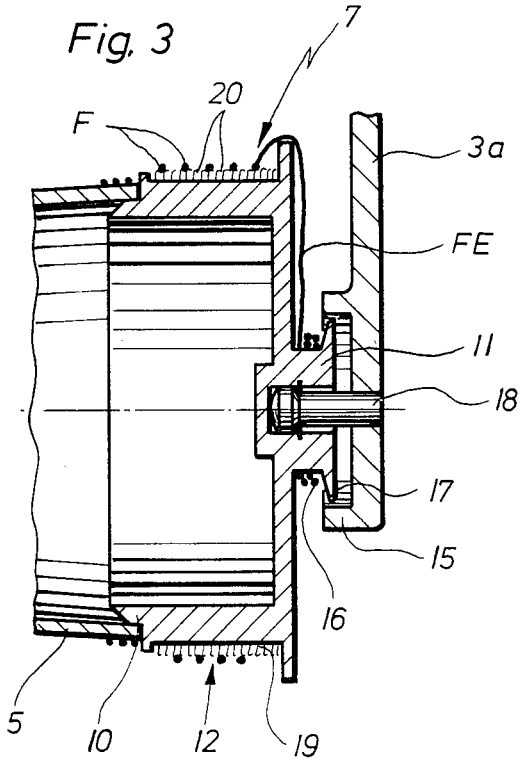
FIG. 3 shows a view in axial section through a first embodiment of the tube plate member.

In the embodiment illustrated in FIG. 3, the catch means 12 comprises a substantially cylindrical surface 19 provided on the tube plate member 7 axially beside the centering projection 10. The surface 19 has increased surface roughness and/or increased adhesiveness. It has been found to be advantageous for the cylindrical surface 19 to be surrounded by a prickly strip 20.

At the beginning of the winding operation, the bobbin tube 5 is fitted on to the centering projection 10 of the tube plate or disc member 7 and on to the corresponding centering projection of the tube plate or disc member 4. The bobbin frame 2 is then pivoted downwardly so that the bobbin tube 5 bears against the grooved drum 6 and is caused to rotate thereby. The bobbin tube in turn also causes the tube plate member 7 to rotate. The thread F is held by an operator or also automatically at an inclined angle over the rotating tube plate member 7 so that it bears against the latter, as can be seen also in FIG. 1. In that operation, the operator cannot precisely determine the length of the end portion of thread that projects beyond the tube plate member 7, as indicated at FE, particularly at high thread delivery rates. The catch means 12, namely the strip 20, engages the thread that is applied thereagainst and entrains it. The thread is firstly wound over a few turns on the strip 20 and then on the bobbin tube 5.

Figure 1:
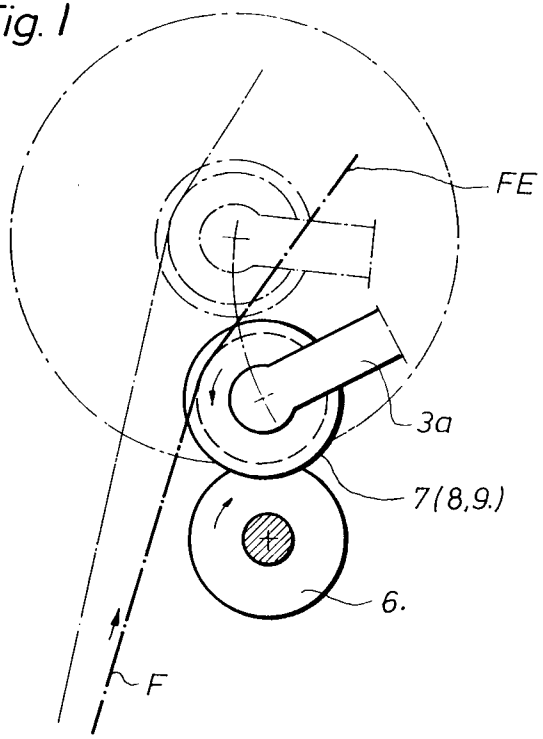
FIG. 1 shows a side view of the bobbin holder.

The thread end FE, which originally hangs over the axial end of the tube plate member 7 in the manner shown in FIG. 1, may sometimes be wound on the strip 20 or on the bobbin tube 5. Typically, however, it continues to hang out over the axial end of the tube plate member 7, and will be wound up in the peripheral groove 16 in the mounting projection 11. In cases where the overhanging thread end FE is thrown farther axially outwardly by the rotation of the bobbin tube 5, rotation of the bobbin tube 5 causes it to hit the support arm 3*a* and to be stopped by the arm for a short time. Then, since the thread end FE is still connected to the portion of the thread which is wound on the strip 20, the thread portion on the strip 20 pulls the thread end FE into the gap between the support arm 3*a* and plate member 7, where it is wound up in the peripheral groove 16 during further rotation of the plate member 7.

If thread breakage should occur during the winding-on operation, the operation of initiating winding on the bobbin can be repeated irrespective of the respective bobbin winding diameter, as shown in FIG. 1, with the thread F always being held in the same fashion at an inclined angle over the tube plate member 7 and then being engaged by the catch means thereof. After the thread has wound itself around the strip 20 for a few turns however, the thread is not then wound on the bobbin tube but on the bobbin winding that has already been previously formed thereon. When the bobbin is full, the bobbin frame 2 is pivoted upwardly and opened. When the bobbin is removed from the bobbin plate member 7, the end portion of thread which is wound on the strip 20 is first automatically unwound, which can be easily done as the tube plate member 7 is freely rotatably mounted. In that case however the portion of thread in the peripheral groove 16 then also continues to unwind automatically, by virtue of free rotational movement of the tube plate member. At the same time, the specific configuration of the mounting projection 11 prevents the overhanging end portion of thread from being wound around any stationary components of the bobbin holder 1. At the same time, the novel configuration of the tube plate member 7 ensures that, after the feed-on operation, the thread is automatically engaged by the grooved drum 6 or a traversing motion thread guide (not shown).

The mode of operation of the two embodiments illustrated in FIGS. 4 and 5 and FIGS. 6 and 7 is substantially the same as the embodiment described hereinbefore. The two embodiments described hereinafter only differ in regard to the configuration of the catch means 13 and 14 respectively.

Figure 5:
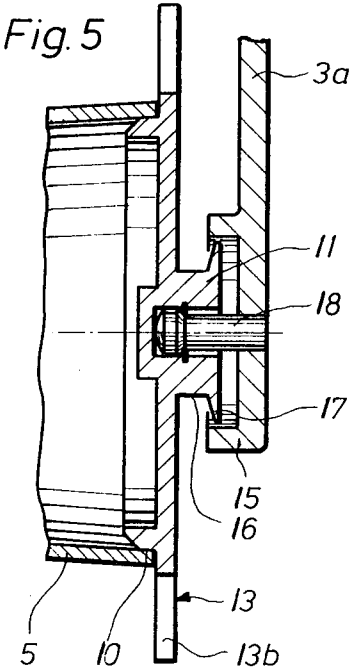
FIG. 5 shows a view in section taken along line V—V in FIG. 4, and FIGS. 6 and 7 show views in axial section of a third embodiment in two different positions.
Figure 4:
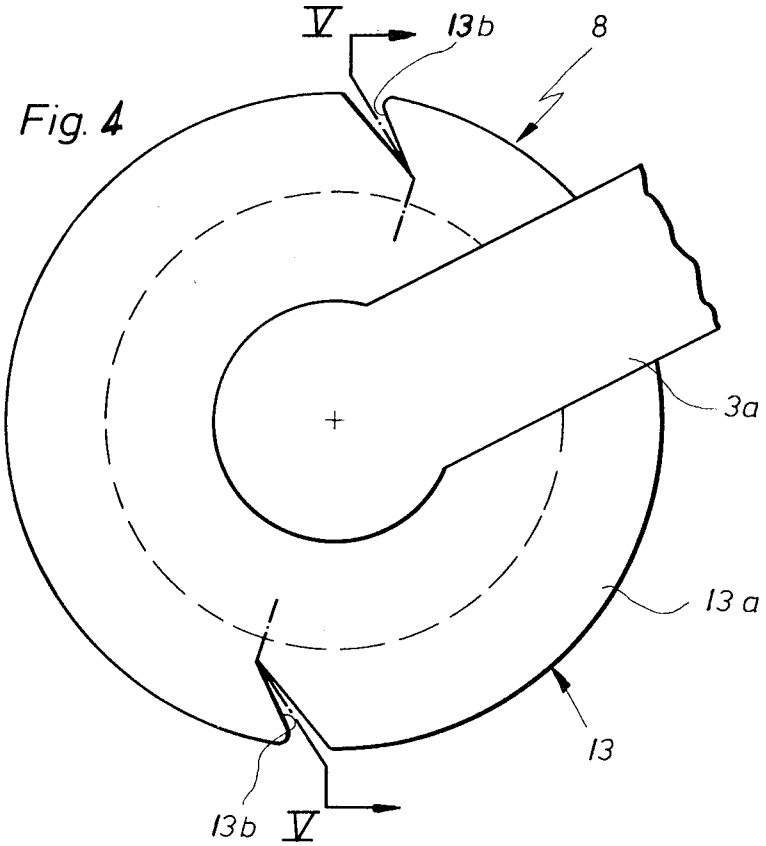
FIG. 4 shows a side view of a second embodiment.

In the embodiment illustrated in FIGS. 4 and 5, the tube plate or disc member 8 has a catch means 13 in the form of a flange 13*a* which projects beyond the centering projection 10 and which has at least one catch notch 13*b*. During the rotational movement of the member 8, the thread F which extends at an inclined angle over the flange 13*a* is engaged by one of the catch notches 13*b* and clamped fast therein. Once again, the overhanging end portion of thread FE is wound on in the peripheral groove 16 of the mounting projection 11.

Figure 7:
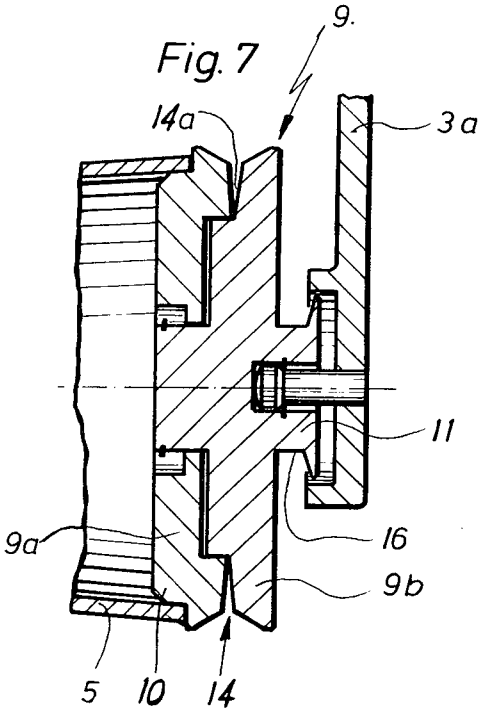
Figure 6:
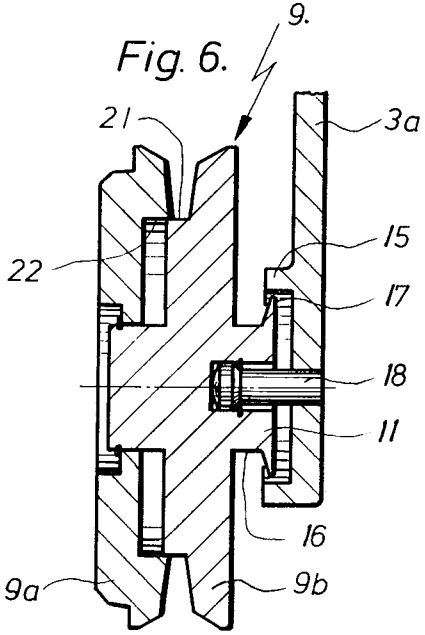

In the embodiment illustrated in FIGS. 6 and 7, the tube plate member 9 essentially comprises two discs 9*a* and 9*b* which are capable of limited movement relative to each other in an axial direction and between the mutually facing surfaces of which is formed a catch means 14 in the form of a peripheral groove 14*a* of V-shaped cross-section. In that arrangement, the apex angle of the peripheral groove 14*a* must be comparatively small so that the thread is securely clamped in the peripheral groove 14*a*. One disc 9*a* has the centering projection 10 while the other disc 9*b* has the mounting projection 11.

When the bobbin tube 5 is fitted into the bobbin frame 2, the resilience of the bobbin frame 2 urges the bobbin tube 5 against the disc 9*a* and the latter against the disc 9*b*. The thread which is applied over the tube plate member 9 is drawn into the peripheral groove 14*a* when the tube plate member rotates, and is automatically clamped therein. The overhanging end portion of thread is again wound in the peripheral groove 16. When the full bobbin is removed, the disc 9*a* is moved away from the disc 9*b* by forces exerted through the thread piece which extends between the full bobbin and the peripheral groove 14A and/or by the tendency of the thread which is wound up in the peripheral groove 14A to resiliently resist radial compression, whereby the peripheral groove 14*a* is increased in width, as shown in FIG. 6. That eliminates the clamping action of the peripheral groove 14*a* and facilitates unwinding of the thread.

So that the thread is not drawn in too far between the two discs 9*a* and 9*b* when winding on the thread and also when winding off the thread, one of the two discs, namely the disc 9*b*, is advantageously provided at the bottom of the peripheral groove 14*a* with a cylindrical projection 21 which projects into a cylindrical recess 22 in the other disc 9*a*.

The embodiments of the invention in which an exclusive property or privilege is claimed are defined as follows:

1. In a bobbin holder which includes a pivotally supported bobbin frame having first and second spaced support arms and which includes first and second tube plate members respectively freely rotatably supported on said first and second support arms of said bobbin frame, wherein said first plate member has a centering projection for supporting a bobbin tube, has thread catch means axially adjacent said centering projection, and has an annular mounting projection which is disposed concentrically around a mounting spindle portion of and projects toward said first support arm and which is concentrically encircled over a part of its axial length by a sleeve-like portion provided on said first support arm, the improvement comprising wherein said mounting projection, in a region thereof spaced axially from said sleeve-like portion, is provided with a peripheral groove into which can be wound an overhanging free end of thread which is free of engagement with said thread catch means.

2. A bobbin holder according to claim 1, wherein said mounting projection has at an end thereof remote from said thread catch means a flange which is encircled by said sleeve-like portion and is disposed a small radial distance therefrom.

3. A bobbin holder according to claim 1, wherein said thread catch means includes a substantially cylindrical surface which is provided on said first tube plate member axially adjacent said centering projection, and including means for causing a thread engaging said cylindrical surface to cling thereto.

4. A bobbin holder according to claim 3, wherein said means for causing a thread to cling to said cylindrical surface includes said cylindrical surface being encircled by a prickly strip.

5. A bobbin holder according to claim 1, wherein said thread catch means includes at least one catch notch provided in a flange which projects radially outwardly beyond said centering projection.

6. A bobbin holder according to claim 1, wherein said thread catch means on said first tube plate member includes said first tube plate member having first and second discs which are supported for limited axial movement relative to each other and have facing surfaces which define a peripheral groove (14*a*) of V-shaped cross-section, wherein said first disc has said centering projection thereon and said second disc has said mounting projection thereon.

7. A bobbin holder according to claim 6, wherein one of said discs has, at the bottom of said peripheral groove, a cylindrical projection which projects into a cylindrical recess provided in the other of said discs.

8. A bobbin holder according to claim 3, wherein said means for causing a thread engaging said cylindrical surface to cling thereto includes said cylindrical surface being roughened.

9. A bobbin holder according to claim 3, wherein said means for causing a thread engaging said cylindrical surface to cling thereto includes adhesive means provided on said cylindrical surface.

* * * * *